US006228492B1

(12) United States Patent
Kinlen et al.

(10) Patent No.: US 6,228,492 B1
(45) Date of Patent: May 8, 2001

(54) PREPARATION OF FIBERS CONTAINING INTRINSICALLY CONDUCTIVE POLYMERS

(75) Inventors: Patrick J. Kinlen, Fenton; Yiwei Ding, St. Louis, both of MO (US); W. Keith Fisher, Gulf Breeze, FL (US)

(73) Assignee: Zipperling Kessler & Co. (GmbH & Co.) (DE)

( * ) Notice: Subject to any disclaimer, the term of this patent is extended or adjusted under 35 U.S.C. 154(b) by 0 days.

(21) Appl. No.: 08/935,435

(22) Filed: Sep. 23, 1997

(51) Int. Cl.[7] ..... D02G 3/00

(52) U.S. Cl. ..... 428/373; 264/131; 264/171.1; 264/171.11; 264/202; 264/210.3; 264/210.8; 427/384; 428/374; 428/395; 428/902

(58) Field of Search ..... 428/373, 374, 428/395, 902; 427/384; 264/444, 131, 202, 210.3, 210.8, 171.1, 171.11

(56) References Cited

U.S. PATENT DOCUMENTS

| | | |
|---|---|---|
| 4,803,096 | 2/1989 | Kuhn et al. . |
| 5,248,554 | 9/1993 | Hsu . |
| 5,294,694 | 3/1994 | Epstein et al. . |
| 5,312,686 | 5/1994 | MacDiarmid et al. . |
| 5,316,830 | 5/1994 | Adams, Jr. et al. . |
| 5,318,845 | 6/1994 | Tanaka et al. . |
| 5,381,149 | 1/1995 | Dougherty et al. . |
| 5,423,956 | 6/1995 | White et al. . |
| 5,494,609 | 2/1996 | Kulkarni et al. . |
| 5,526,324 | 6/1996 | Cushman . |
| 5,567,356 | 10/1996 | Kinlen . |

FOREIGN PATENT DOCUMENTS

WO90/03102 3/1990 (WO) .

OTHER PUBLICATIONS

Andreatta et al., Electrically–Conductive Fibers of Polyaniline Spun From Solutions In Concentrated Sulfuric Acid, Synthetic Metals, 26:383–389 (1988).

Frushour et al., Acrylic Fibers, Fiber Chemistry, 6:341–342 (1985).

McIntyre, Antistatic Fibres, Rep. Prog. Appl. Chem., 59:99–108 (1974).

Olmedo et al., Microwave Properties Of Conductive Polymers, Synthetic Metals, 69:205–208 (1995).

Salaneck et al., Conjugated Polymers And Related Materials, Oxford University Press, 6:73–98 (1993).

*Primary Examiner*—Richard Weisberger
(74) *Attorney, Agent, or Firm*—Howell & Haferkamp, L.C.

(57) ABSTRACT

A process for preparing fibers containing intrinsically conductive polymers comprises extruding two or more filaments, applying a coating formulation containing a salt of an intrinsically conductive polymer to at least one of the filaments to form a coated filament, combining the filaments to form a filament bundle, and processing the bundle into a fiber. A filament coated with an intrinsically conductive polymer and a fiber comprising at least one coated filament are also provided which are useful in preparing textiles and other materials which exhibit conductivity.

20 Claims, 10 Drawing Sheets

(8 of 10 Drawing Sheet(s) Filed in Color)

PREPARATION OF FIBERS CONTAINING INTRINSICALLY CONDUCTIVE POLYMERS

BACKGROUND OF THE INVENTION

1. Field of the Invention

The present invention relates generally to the preparation of conductive fibers, and more particularly to the preparation of fibers containing intrinsically conductive polymers.

2. Description of the Prior Art

Synthetic fibers are widely used in the textile industry and are increasingly being used outside the classical textile fields in novel applications such as fibers for reinforcing thermoplastics and duroplastics used in manufacturing automobiles, airplanes and buildings; optical fibers for light telephony; and fibrous materials for numerous medical applications. This diverse application of synthetic fibers is largely based on the development of techniques for "tailor-making" fibers to provide physical properties that are desirable for a particular use.

When used in textiles, for example, it is often desirable that synthetic fibers have low resistivity, or an electrical conductivity sufficient to dissipate static electrical charge. This would reduce or prevent the development of static electricity, which causes fabrics comprised of such fibers to cling and to be difficult to clean. However, some of the most important synthetic fibers, particularly nylon, polyester, and acrylic fibers, have low electrical conductivity. Thus, the development of methods for increasing the electrical conductivity of synthetic fibers is an area of active research in the textile industry.

For example, techniques suggested to increase conductivity in polyester fibers include dispersing fibrils comprised of a hydrophilic or conductive polymer in the polyester matrix, forming sheath-core bicomponent fibers with a polymer containing conductive carbon black or a metal oxide in the sheath or in the core, and metallizing or graphitizing the fiber surface. See, e.g., J. E. McIntrye, *Polyester Fibers, in Fiber Chemistry*, 40–41, 1–71 (Menachim Lewin & Eli M. Pearce eds., 1985), incorporated herein by reference.

Reported methods for making electrically conductive acrylic fibers include incorporating carbon black into the fibers during the spinning process and treating spun fibers with zinc oxide or copper ions. See, e.g., Bruce G. Frushour & Raymond S. Knorr, *Acrylic Fibers, in Fiber Chemistry*, 341–342, 171–370 (Menachim Lewin & Eli M. Pearce eds., 1985), incorporated herein by reference.

The above methods involving carbon black produce fibers of limited use in that they are black or grey. Moreover, many composite fibers containing metal oxide have poor durability when used in textiles.

In addition, some groups have recently tried incorporating an intrinsically, conductive polymer into synthetic fibers to improve their electrical conductivity. An intrinsically conductive polymer (ICP) is an organic polymer which has a poly-conjugated $\pi$-electron system such as double or triple bonds, or aromatic or heteroaromatic rings. For a review, see Conjugated Polymers and Related Materials (W. R. Salaneck et al. eds., Oxford University Press 1993), incorporated herein by references. Sometimes referred to as "synthetic metals", intrinsically conductive polymers (ICP's) are completely different from "conducting polymers" which are physical mixtures of a nonconductive polymer with a conducting material such as a metal or carbon powder distributed throughout the material.

An ICP may exist in various electrochemical forms which can generally be reversibly converted into one another by electrochemical reactions such as oxidation, reduction, acid/alkali reactions or complexing. These reactions are also referred to in the literature as "doping" or "compensation". At least one of the possible electrochemical forms of an ICP is as a very good conductor of electricity, e.g., has a conductivity of more than 1 S/cm (in pure form). Electrically conductive forms of an ICP are generally regarded as polyradical cationic or anionic salts.

Although ICP's have a number of potential uses, their conductive properties make ICP's a desirable component of fibers for use in textiles, carpets and other commercial applications.

For example, U.S. Pat. No. 5,423,956 to White et al. discloses a process for making composite polymer fibers in which a coating of a conductive organic polymer is electrochemically formed on the outer surface of a polymeric fiber. Similarly, polyaniline with a counterion doping agent has been polymerized onto the surface of a fiber or fabric material. (See U.S. Pat. No. 4,803,096 to Kuhn et al., incorporated herein by reference.) These and other processes which polymerize polyaniline on the surface of fibers, or textiles, are unsatisfactory in that they require an additional manufacturing step which, besides adding cost to the product, adds significant technical problems in the control and operation of such processes.

In addition, several methods of preparing fibers containing the intrinsically conductive form of polyaniline have recently been reported. Andreatta and coworkers report a method of producing fibers of polyaniline from a solution in concentrated sulfuric acid (Andreatta et al., 26 *Synth. Met.* 383–389 (1988), incorporated herein by reference). However, fibers composed entirely of polyaniline are often brittle and inflexible and thus not suitable for use in textiles or carpets.

High molecular weight polyaniline has also been spun into fibers from the nonconductive form dissolved in N-methyl pyrrolidone followed by subsequent doping of the fibers with HCl to produce the conductive form of polyaniline. (See, for example, U.S. Pat. No. 5,312,686 to MacDiarmid et al., incorporated herein by reference.) This and other approaches which add dopants after formation of the fiber form fibers in which the conductivity is of limited durability in that they usually require that small dopant molecules be used so that doping time will not be prohibitively long. However, these low molecular weight dopants can diffuse out of a fiber when it is washed or heated, leaving the fiber undoped, i.e., nonconductive.

It has also been proposed to use ICP's such as polyaniline as an additive in fibers spun from molten polymers such as polypropylene and Nylon. An inherent barrier to the use of ICP's as an additive in melt-spun fibers is their thermal instability at the temperatures required for melt-spinning.

Another approach is described in U.S. Pat. No. 5,248,554 to Hsu, in which filaments of p-aramid yarns are impregnated with a polyaniline by passing the yarn through a solution of polyaniline in sulfuric acid. The sulfuric acid causes the fiber to swell and ultimately causes longitudinal cracks in the fiber, allowing the polyaniline to penetrate into the fiber. The polyaniline may be undoped, thus requiring subsequent doping to enhance conductivity, or the polyaniline may be a sulfonated polyaniline that does not require subsequent doping. However, impregnation of p-aramid filaments with polyaniline in sulfuric acid requires careful control of the concentration and time of exposure to the sulfuric acid to avoid excessive cracking of the filaments and loss of tensile properties. Moreover, unless rendered insoluble by heat treatment of the fiber, the impregnated sulfonated polyaniline is somewhat soluble in 0.1 M ammonium hydroxide.

Despite the previous efforts to incorporate protonated, or doped polyaniline into fibers which have properties suitable for commercial use, the described processes are either complicated and/or the conductivity of the fibers produced is of limited durability. Thus, there continues to be a need for incorporating ICP's into fibers formed from any a variety of polymers, copolymers, or polymer blends using standard fiber manufacturing processes to produce fibers which exhibit conductivity in a dry environment even after repeated flexing and washing.

SUMMARY OF THE INVENTION

Briefly, therefore, the present invention is directed to a novel method for spinning fibers containing intrinsically conductive polymers and to fibers produced by this method. The method comprises extruding two or more filaments comprised of a fiber-forming polymer, applying a coating formulation containing an intrinsically conductive polymer to at least a portion of at least one of the filaments, combining the filaments to form a filament bundle and processing the filament bundle into a fiber. Preferably, the coating formulation is applied before the filaments have completely solidified.

As used herein, a filament is defined as comprising a single, continuous strand of a polymer, i.e., a monofilament, and a fiber is defined as comprising two or more filaments. The fiber-forming polymer comprising the filament may be a homopolymer or copolymer. Preferably, the fiber-forming polymer comprises one or more of a polyolefin, a polyamide, a polyester, an acrylic, or derivatives thereof and the filament is formed by a melt spinning process.

The coating formulation used in the invention comprises an ICP in a carrier solvent. A variety of known coating formulations may be used, including solutions wherein the ICP is dissolved in the carrier solvent and dispersions of ICP particles in the carrier solvent.

In accordance with another embodiment of the invention, a fiber containing an ICP is provided which comprises at least two filaments comprised of a fiber-forming polymer, at least one of the filaments having a coating containing an ICP, the coating covering at least a portion of the filament.

The present invention also provides a coated filament comprising a fiber-forming polymer and a coating containing an intrinsically conductive polymer.

Among the several advantages found to be achieved by the present invention, therefore, may be noted the provision of a method for preparing an ICP-containing fiber suitable for use in textile materials; and the provision of a fiber made by this method in which the ICP-containing fiber is flexible, strong, and conductive in a dry environment even after repeated flexing and washing of the fiber.

BRIEF DESCRIPTION OF THE DRAWINGS

The file of this patent contains at least one drawing executed in color. Copies of this patent with color drawing (s) will be provided by the Patent and Trademark Office upon request and payment of necessary fee.

FIG. 1A is a frontal view of the process showing melt-spun filaments emerging from a spin pack, descending in a quench chimney to a solution applicator where they are coated with a coating formulation, and subsequently merged into a threadline or fiber and FIG. 1B is a side view of the process shown in FIG. 1A.

FIG. 2A is a cross-sectional view of the fiber taken at 640× magnification showing the polyaniline coating on the exterior surface of individual filaments in the fiber; and FIG. 2B is a longitudinal view taken at 800× magnification showing the polyaniline coating on the surface of a single filament in the fiber.

FIG. 3A is a cross-sectional view and FIG. 3B is a longitudinal view as described in FIGS. 2A and 2B, respectively.

FIG. 4A and FIG. 4B are cross-sectional and longitudinal views, respectively, as described in FIGS. 2A–B, with FIG. 4B also showing part of a second filament in the fiber.

FIG. 5A and FIG. 5B are cross-sectional and longitudinal views, respectively, as described in FIGS. 2A–B.

DESCRIPTION OF THE PREFERRED EMBODIMENTS

Figure 1A:
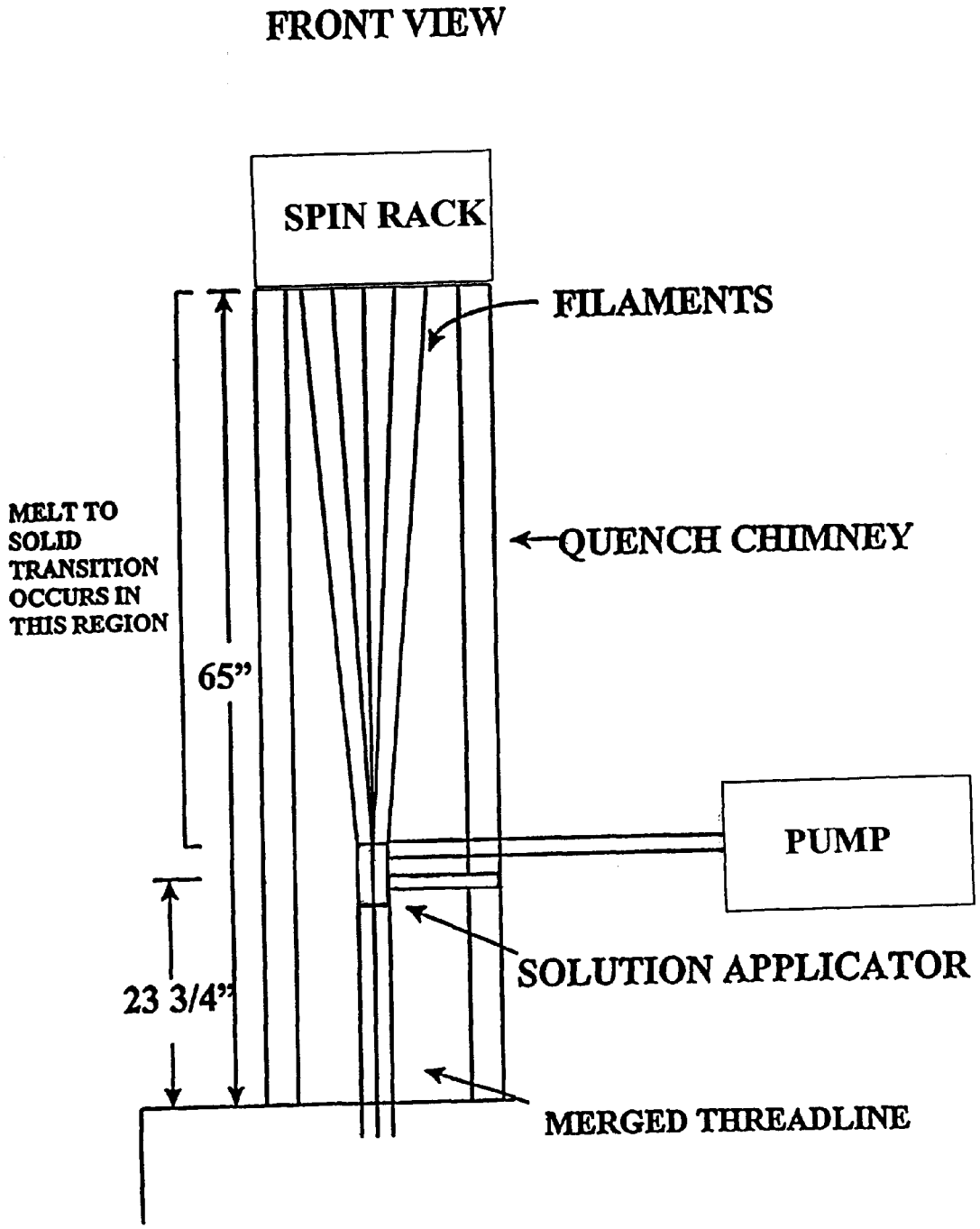
FIGS. 1A and 1B illustrate the preparation of an ICP-containing fiber according to a preferred embodiment of the invention.

In accordance with the present invention, it has been discovered that an ICP-containing fiber may be prepared by coating at least one of the filaments extruded during a fiber spinning process with the ICP. The ICP-coated filament is then combined with the other extruded filaments to form a filament bundle which is processed into the ICP-containing fiber.

The filaments are comprised of a fiber-forming polymer. This fiber-forming polymer can be any of a number of polymers known to be suitable for producing fibers for use in textile materials. Typically, such fibers have suitable tensile properties which can be characterized by measurements such as tenacity. As used herein, tenacity is the breaking load of a fiber in grams per denier, a denier being the mass in grams of 9,000 meters of the fiber. Polymers capable of forming fibers suitable for use in textile materials typically have tenacity values of from about 0.5 to about 11.0 g/den. Polymers preferred for use in the present invention have tenacity values equal to or greater than 1.0 g/den, equal to or greater than about 5 g/den, or equal or greater than about 7.5 g/den.

A wide variety of synthetic polymers have such tenacity values and thus are suitable for use in the present invention. Suitable polymers include, for example, cellulose (including cellulose acetate, cellulose triacetate and viscous cellulose); polyacrylonitrile; polyamides; polyesters; polyolefins; polyurethanes; polyvinyl alcohols; polyvinyl chloride; co-polymers thereof; and blends comprising predominately such polymers. Preferred polymers are those which are melt-processible, including polyamides, polyesters such as polyethylene terephthalate and polybutylene terephthalate, and polypropylenes. Preferred polyamides are nylons such as nylon 66 and nylon 6. It will be understood by those skilled in the art that the intended use of the coated fiber will dictate, to a large extent, which polymer would be preferred for forming the fiber. For example, polyester may be the polymer of choice for making coated fibers to be used in work apparel while polypropylene would likely be the preferred polymer to make coated fibers for flexible intermediate bulk containers (FIBCS)

The filament components of the fiber may be extruded by any spinning process suitable for the manufacture of fibers from a particular polymer, including, for example, melt spinning, reaction spinning, plasticized-melt spinning, tack spinning, wet spinning, dispersion spinning, dry-spinning, dry-jet wet spinning or air-gap spinning, emulsion spinning, gel spinning, grid spinning, reaction spinning and the like. In general, these spinning processes comprise forcing a polymer melt or solution through multiple holes in a spinneret to generate liquid polymer streams that solidify into filaments which are ultimately combined together into a fiber. The preferred technique for spinning the filaments is by a melt-spinning process which will be described in more detail below.

At least one of the extruded filaments is coated by applying a coating formulation comprising an ICP in a carrier medium to at least a portion of the exterior surface of the filament to form a coated filament. Preferably, the coating formulation is applied to filaments that are not completely solidified to provide improved adherence of the ICP to the filament. An incompletely solidified filament is defined as being solid enough to have sufficient tensile strength to not break its thread line during application of the coating but is not yet completely crystallized. For example, adherence of the ICP to melt-spun polypropylene filaments was improved when a coating formulation comprising a solution of an organic acid salt of polyaniline in toluene was applied to apparently solid, but incompletely cooled filaments rather than at the downstream lubrication point where a finish oil is usually applied. In addition, prior to application of the coating formulation, it is preferred that the filament not be pretreated with any oil or other substance that may interfere with the bonding of the ICP to the filament.

Generally, the ICP will comprise about 0.1% to about 80%, by weight, of the coating formulation. More preferably, the ICP comprises between about 1% and 50%, by weight, of the coating formulation.

Preferably, the ICP in the coating formulation is an ICP that provides the resulting fiber with electrical conductivity in a dry environment. Examples of ICP's useful in the present invention include but are not limited to: polyacetylene; polyaniline; polycarbazole; polyfuran; polyheteroarylenevinylene, in which the heteroarylene group is thiophene, furan or pyrrole; polyisothionaphene; polyparaphenylene; polyparaphenylene sulphide; polyparaphenylene vinylene; polyperinaphthalene; polyphthalocyanine; polypyrrole; polyquinoline; and polythiophene. Useful ICP's also include mixtures, copolymers, and derivatives of the aforesaid polymers, e.g., in which the monomer components have substituted side chains or groups. ICP's preferred for use in the present invention are polyaniline, polypyrrole, and polythiophene.

A particularly preferred ICP is an organic acid salt of a polyaniline. In general, the polyaniline may be a homopolymer or copolymer derived from the polymerization of unsubstituted or substituted anilines having the formula:

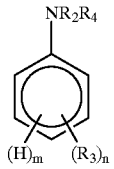

wherein n is an integer from 0 to 4; m is an integer from 1 to 5 with the proviso that the sum of n and m is equal to 5; $R_2$ and $R_4$ are the same or different and are $R_3$ substituents, hydrogen or alkyl; and $R_3$ is the same or different at each occurrence and is selected from the group consisting of alkyl, deuterium, alkenyl, alkoxy, cycloalkyl, cycloalkenyl, alkanoyl, alkythio, aryloxy, alkylthioalkyl, alkylaryl, arylalkyl, amino, alkylamino, dialkylamino, aryl, alkylsulfinyl, aryloxyalkyl, alkylsulfinylalkyl, alkoxyalkyl, phosphonic acid, alkylsulfonyl, arylthio, alkylsulfonylalkyl, boric acid, phosphoric acid, sulfinate, arylsulfinyl, alkoxycarbonyl, arylsulfonyl, carboxylic acid, phosphonic acid, halogen, hydroxy, cyano, sulfinic acid, carboxylate, borate, sulfonate, phosphinate, phosphonate, phosphonic acid, sulfonic acid, nitro, alkylsilane or alkyl substituted with one or more phosphonic acid, sulfonic acid, phosphoric acid, boric acid, carboxylate, borate, sulfonate, phosphinate, phosphate acid, phosphinic acid, carboxylic acid, halo, nitro, cyano or epoxy moieties; or any two $R_3$ groups together or any $R_3$ group together with any $R_1$ or $R_2$ group may form an alklene or alkenylene chain completing a 3, 4, 5, 6 or 7 membered aromatic or alicyclic ring, which ring may optionally include one or more divalent nitrogen, sulfur, sulfinyl, ester, carbonyl, sulfonyl, or oxygen atoms; or $R_3$ is a divalent organic moiety bonded to the same or a different substituted or unsubstituted aniline moiety or $R_3$ is an aliphatic moiety having repeat units of the formula:

$$—(—OCH_2CH_2—)_q—O—CH3,\ —(—OCH_2CH(CH_3)_q—O—CH_3,\ —(—CH_2—)_q—CF_3,\ —(—CF_2—)_q—CF_3 \text{ or } —(—CH_2—)_q—CH_3$$

wherein q is a positive whole number; with the proviso that said homopolymer or copolymer includes about 10 or more recurring substituted or unsubstituted aniline aromatic moieties in the polymer backbone.

The following substituted and unsubstituted anilines are illustrative of those which can be used in the synthesis of the polyanilines useful in the present invention: 2-cyclohexylaniline, aniline, o-toluidine, 4-propanoaniline, 2-(methylamino)aniline, 2-dimethylaminoaniline, 2-methyl-4-methoxycarbonylaniline, 4-carboxyaniline, N-methyl aniline, N-propyl aniline, N-hexyl aniline, m-toluidine, o-ethylaniline, m-ethylaniline, o-ethoxyaniline, m-butylaniline, m-hexylaniline, m-octylaniline, 4-bromoaniline, 2-bromoaniline, 3-bromoaniline, 3-acetamidoaniline, 4-acetamidoaniline, 5-chloro-2-methoxy-aniline, 5-chloro-2-ethoxy-aniline, N hexyl-m-toluidine, 2-acetylaniline, 2,5 dimethylaniline, 2,3 dimethylaniline, N,N dimethylaniline, 4-benzylaniline, 4-aminoaniline, 2-methylthiomethylaniline, 4-(2,4-dimethylphenyl) aniline, 2-ethylthioaniline, N-methyl-2,4-dimethylaniline, N-propyl m- toluidine, N-methyl o-cyanoaniline, 2,5 dibutylaniline, 2,5 dimethoxyaniline, tetrahydronaphthylaniline, o-cyanoaniline, 2-thiomethylaniline, 2,5-dichloroaniline, 3-(n-butanesulfonic acid) aniline, 3-propoxymethylaniline, 2,4-dimethoxyaniline, 4-mercaptoaniline, 4-ethylthioaniline, 3-phenoxyaniline, 4-phenoxyaniline, 4-phenylthioaniline, 3-amino-9-methylcarbazole, 4-amino carbazole, N-octyl-m-toluidine, 4-trimethylsilylaniline, 3-aminocarbazole, N-(paraaminophenyl) aniline. Unsubstituted polyaniline is preferred.

The organic acid of the polyaniline salt is one which has a nonpolar or slightly polar substituent group. Also, the organic acid must be of the type that results in a polyaniline salt having electrical conductivity. In general, the organic acid is used as a dopant to the polyaniline and results in the protonation of the polyaniline and formation of a salt of the organic acid with the polyaniline. The organic acid dopant may be applied to the polyaniline either during or after polymerization of the aniline.

Organic acids which are suitable for use in the present invention are, in general, those having the formula $M^+$—$[SO_3^-$—R], wherein M is a metal or non-metal cation; R is substituted or unsubstituted alkyl, phenyl, naphthalene, anthracene or phenanthrene, which may have from zero to about four substituents and wherein permissible substituents are selected from the group consisting of alkyl, phenyl, haloalkyl, perhaloalkyl, and wherein the substituent group has from about 6 to about 30 carbon atoms. Preferred for use in the polyaniline salts used in the present invention are organic acids wherein M is hydrogen and R is dinonylnaphthalene, i.e., dinonylnaphthalene sulfonic acid.

The polyaniline salts preferred for use in the present invention may be formed by any method, but are preferably soluble in a number of carrier solvents to facilitate application of the polyaniline to the filaments. In particular, the polyaniline salt used in the present invention is soluble in xylene to the extent of at least 0.1% on a weight/weight basis, preferably at least 1%, more preferably to the extent of at least about 5%, still more preferably at about 10%, even more preferably at about 20%. Most preferably the polyaniline salt is soluble in xylene at least about 25% or greater, i.e., at least about 25 grams of such a polyaniline salt would be soluble in 75 grams of xylene at 60° F.

An especially preferred organic acid salt of polyaniline is one prepared by an emulsion-polymerization method as described in U.S. Pat. No. 5,567,356 to Kinlen, which is hereby incorporated herein by reference. Briefly, the method disclosed in that patent involves combining water, a water-solubilizing organic solvent, an organic acid that is soluble in the organic solvent, aniline, and a radical initiator. A preferred organic solvent for use in this emulsion-polymerization method is 2-butoxyethanol. The organic acid soluble in the water-solubilizing organic solvent can be any one of a number of organic acids including sulfonic acids, phosphorus-containing acids, carboxylic acids or mixtures thereof. Preferred organic sulfonic acids are dodecylbenzene sulfonic acid, dinonylnaphthalenesulfonic acid (DNNSA), dinonylnaphthalenedisulfonic acid, p-toluene sulfonic acid, or mixtures thereof. A most preferred organic sulfonic acid is DNNSA. Preferably, the polymerization reaction mixture contains DNNSA and aniline in a mole ratio of 1.2:1.

The organic acid salt of polyaniline produced by this emulsion-polymerization method has a molecular weight, as measured by number average ($M_n$) or weight average ($M_w$) of at least 2000, more preferably at least about 4000, still more preferably at least about 10,000, and most preferably at least about 50,000 or 100,000 or greater. The ratio of $M_w$:$M_n$, which indicates the molecular weight distribution of the polyaniline, is preferably about 1.9 or less. In addition, the polyaniline salt produced by this method is readily processible as a result of its being highly soluble in a variety of organic carrier solvents. For example, one such organic carrier solvent is xylene which dissolves the preferred polyaniline salt at a concentration equal to or greater than about 25% by weight.

In addition to the ICP, the coating formulation comprises a carrier medium and may contain other components which are added to achieve desirable properties. Various coating formulations for forming a ICP-containing film on different substrates are known in the art. The choice of the composition of the coating formulation for use in the present invention will vary depending on the particular combination of fiber-forming polymer, method for applying the coating to the filament, the ICP being used, and the physical properties desired for the resulting coated filament. Those skilled in the art may readily determine what coating formulation should be used for a particular combination.

For example, a coating formulation useful in the present invention is a dispersion comprising ICP particles in a solvent carrier medium. The ICP particles have a size of about 0.02 to about 3 microns, preferably the particles range from about 0.1 to 0.2 microns. The carrier solvent may be a polar solvent such as water, acetone, ethanol and isopropanol. Alternatively, the carrier medium may comprise an organic solvent in which the ICP particles are insoluble. Preferably, the carrier medium is an aqueous liquid.

Another coating formulation useful in the invention comprises a solution of a salt of an ICP in a carrier solvent. The carrier solvent is one in which the ICP is substantially soluble, as generally understood by those skilled in the art, and one which will allow the ICP to form a film on the filament or form a composite with a binder material. For example, a solution coating formulation may comprise an organic acid salt of polyaniline in a nonaqueous organic carrier solvent such as xylene, toluene, 4-methyl-2-pentanone, n-decyl alcohol, trichloroethylene, butylacetate, 2-butoxyethanol chloroform, hexanes, cyclohexane, 1-pentanol, 1-butanol, 1-octanol, 1,4-dioxane, and m-cresol. Mixed solvents can be used as well.

The coating formulation may also comprise a film-forming nonconductive polymer which is soluble in the carrier solvent. For example, Kulkarni et al., U.S. Pat. No. 5,494,609, incorporated herein by reference, describes an electrically conductive coating composition comprising a dispersion comprising a solution of a film-forming thermoplastic polymer dissolved in an organic solvent having ICP particles dispersed therein. Examples of useful thermoplastic film-forming polymers include acrylic polymers such as polybutylmethacrylate and polymethyl methacrylate; polyester; polycarbonate; polyvinyl chloride and copolymers thereof with vinyl acetate; amorphous nylons; styrenic polymers; and mixtures thereof.

The coating formulation may also contain a binder material, to enhance adherence of the ICP to the polymer filament. Any binder material capable of providing the desired adherence properties and capable of being blended with the ICP can be used in connection with the present invention. The binder material may be an inorganic compound such as a silicate, a zirconate, or a titanate or an organic compound such as a polymeric resin. Exemplary organic resins include shellac, drying oils, tung oil, phenolic resins, alkyd resins, aminoplast resins, vinyl alkyds, epoxy alkyds, silicone alkyds, uralkyds, epoxy resins, coal tar epoxies, urethane resins, polyurethanes, unsaturated polyester resins, silicones, vinyl acetates, vinyl acrylics, acrylic resins, phenolics, epoxy phenolics, vinyl resins, polyimides, unsaturated olefin resins, fluorinated olefin resins, crosslinkable styrenic resins, crosslinkable polyamide resins, rubber precursor, elastomer precursor, ionomers, mixtures and derivatives thereof, and mixtures thereof with crosslinking agents.

The binder may also be a cross-linkable resin selected from the epoxy resins, polyurethanes, unsaturated polyesters, silicones, phenolic and epoxy phenolic resins. Exemplary cross-linkable resins include aliphatic amine-cured epoxies, polyamide epoxy, polyamine adducts with epoxy, ketimine epoxy coatings, aromatic amine-cured epoxies, silicone modified epoxy resins, epoxy phenolic coatings, epoxy urethane coatings, coal tar epoxies, oil-modified polyurethanes, moisture cured polyurethanes, blocked urethanes, two component polyurethanes, aliphatic isocyanate curing polyurethanes, polyvinyl acetals and the like, ionomers, fluorinated olefin resins, mixtures of such resins, aqueous basic or acidic dispersions of such resins, or aqueous emulsions of such resins, and the like. Methods for preparing these polymers are known or the polymeric material is available commercially. Suitable binder materials are described in "Corrosion Prevention by Protective Coatings" by Charles G. Munger (National Association of Corrosion Engineers 1984 which is incorporated by reference). It should be understood that various modifications to the polymers can be made such as providing it in the form of a copolymer. The binder can be either aqueous based or solvent based.

The binder material can be prepared and subsequently blended with the polyaniline salt composition or it can be combined with the polyaniline salt composition and treated or reacted as necessary. When a cross-linkable binder is used, the binder may be heated, exposed to electron beams and ultraviolet light, or treated with the cross-linking component subsequent to the addition of the polyaniline salt composition or concurrently therewith. In this manner it is possible to create a coating composition where the polyaniline salt composition is cross-linked with the cross-linkable binder.

Cross-linkable binders particularly suitable for this application include the two component cross-linkable polyurethane and epoxy systems as well as the polyvinylbutyral system that is cross-linked by the addition of phosphoric acid in butanol. Typical polyurethane coatings are made by reacting an isocyanate with hydroxyl-containing compounds such as water, mono- and diglycerides made by the alcoholysis of drying oils, polyesters, polyethers, epoxy resins and the like. Typical epoxy coatings are prepared by the reaction of an amine with an epoxide, e.g., the reaction of bisphenol A with epichlorohydrin to produce an epoxide that is then reacted with the amine. A blending method could, for example, involve polymerizing the polyaniline salt in a host polymer matrix such as polyvinylbutyral. When epoxies or polyurethanes are used as the host polymer matrix, a blend of polyaniline and the base polymer could be formulated and the cross-linking catalyst added just prior to the coating application. Alternatively, the polyaniline salt composition is blended with the cross-linking catalyst.

The coating formulation may also include a conductivity enhancing agent. One such conductivity enhancing agent is an ionic surfactant as described in the copending application Ser. No. 08/690,213 U.S. Pat. No. 5,840,214, which is incorporated herein by reference. Useful ionic surfactants have a hydrophobic component such that the ionic surfactant is soluble in an organic solvent in which the polyaniline salt is also soluble, for example, a xylene. Suitable solvents are those in which both of the polyaniline salt and the ionic surfactant are soluble in an amount of at least about 1% w/w for each of the polyaniline salt and the ionic surfactant.

A conductivity enhancing ionic surfactant can be selected from cationic surfactants, anionic surfactants, amphoteric surfactants, or combinations thereof. Cationic surfactants may be protonated long-chain quaternary ammonium compounds and are particularly useful as the inorganic salt form of the quaternary ammonium ion. Anionic surfactants possess anionic head groups which can include long-chain fatty acids, sulfosuccinates, alkyl sulfates, phosphates, and sulfonates. Exemplary anionic surfactants are alkali metal salts of a diphenyl oxide disulfonate such as diphenyl oxide disulfonates sold under the trade names DOWFAX® 2AO (CAS No. 119345-03-8) and 2A1 (CAS No. 119345-04-9) by Dow Chemical Company (Midland, Mich.). Amphoteric surfactants are known in the art and can include compounds having a cationic group such as an amine or sulfonium group as well as an anionic group such as carboxyl or sulfonate group. One particularly useful amphoteric surfactant is 3-cyclohexylamine-1-propane sulfonic acid.

The coating formulation may be applied to the filament by any of a number of methods of application. Such methods include spraying the coating formulation onto the filament, brushing the filament with the coating formulation, dipping the filament into the coating formulation, and contacting the filaments with a contact or lick roll rotating in a small bath. The coating application method should result in at least 10% of the surface area of the filament being coated, preferably at least 25%, more preferably at least about 50%, still more preferably at least about 75%, and most preferably at least about 90%.

A particularly useful coating application method is similar to the finish coating approach commonly employed in a melt-spinning process and applies the coating formulation to a majority of the individual extruded filaments at a point in the process before the filaments are combined into a filament bundle. This preferred coating application method comprises contacting each of a majority of the filaments with a pen having a wick to which the coating formulation is delivered by a metered pump. Preferably, the flow rate of the coating formulation and the shape and structure of the wick are such that the coating formulation is applied to at least 25%, more preferably at least 50%, and most preferably at least 75%, of the extruded filaments which are subsequently processed into a fiber.

The thickness of the ICP-containing coating may vary along the length of the coated portion of a filament, depending on what is the desired amount of conductivity and durability for the coated filament. If the coating is too thin, the desired amount of conductivity may not be achieved. If the coating is too thick, the coating may be too brittle or it may crack. Preferably the ICP-coating is between about 0.05 and $3\mu$, and more preferably is between 0.05 and $0.3\mu$. Most preferably, the ICP-coating is about 0.1 to $0.15\mu$.

Figure 2A:
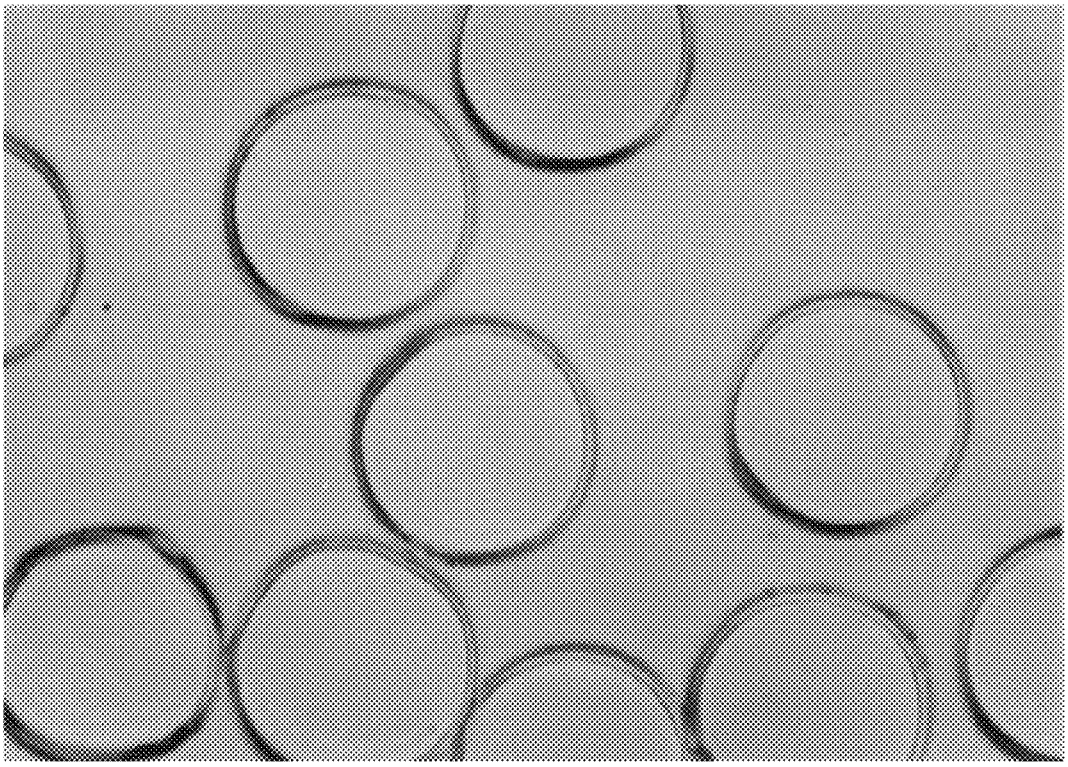
FIGS. 2A–B illustrate photomicrographs of a polyaniline-containing polypropylene fiber prepared according to the invention using a toluene based formulation containing 14% polyaniline by weight.
Figure 2B:
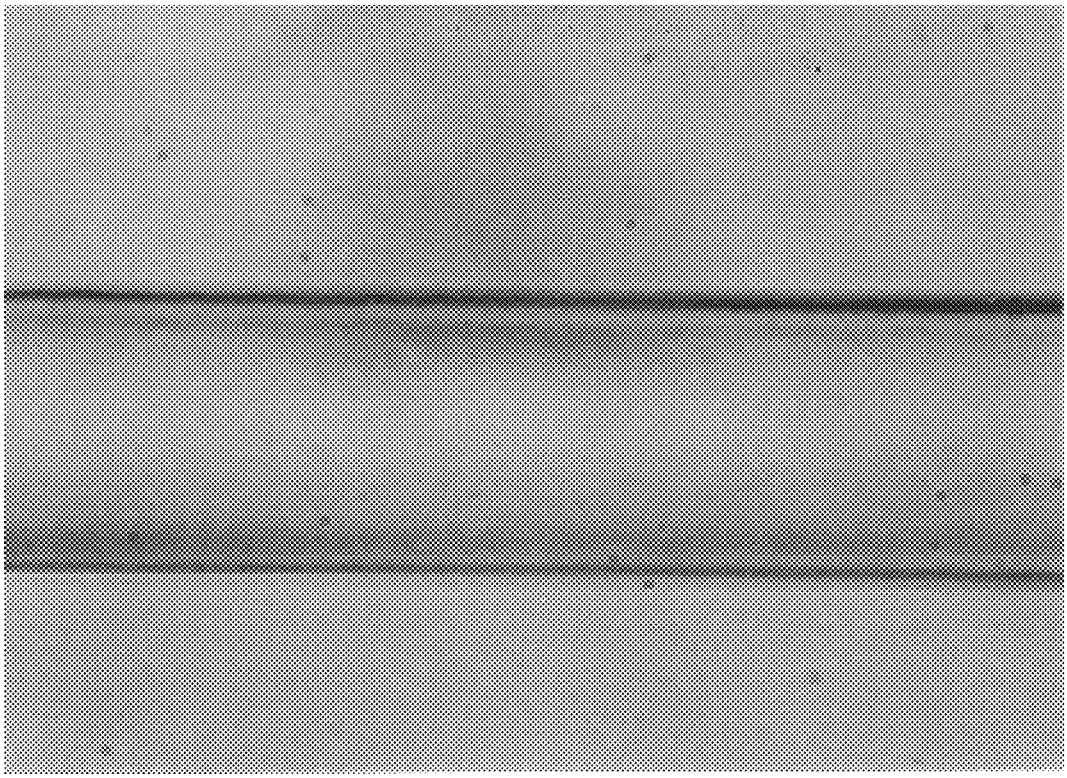
Figure 3A:
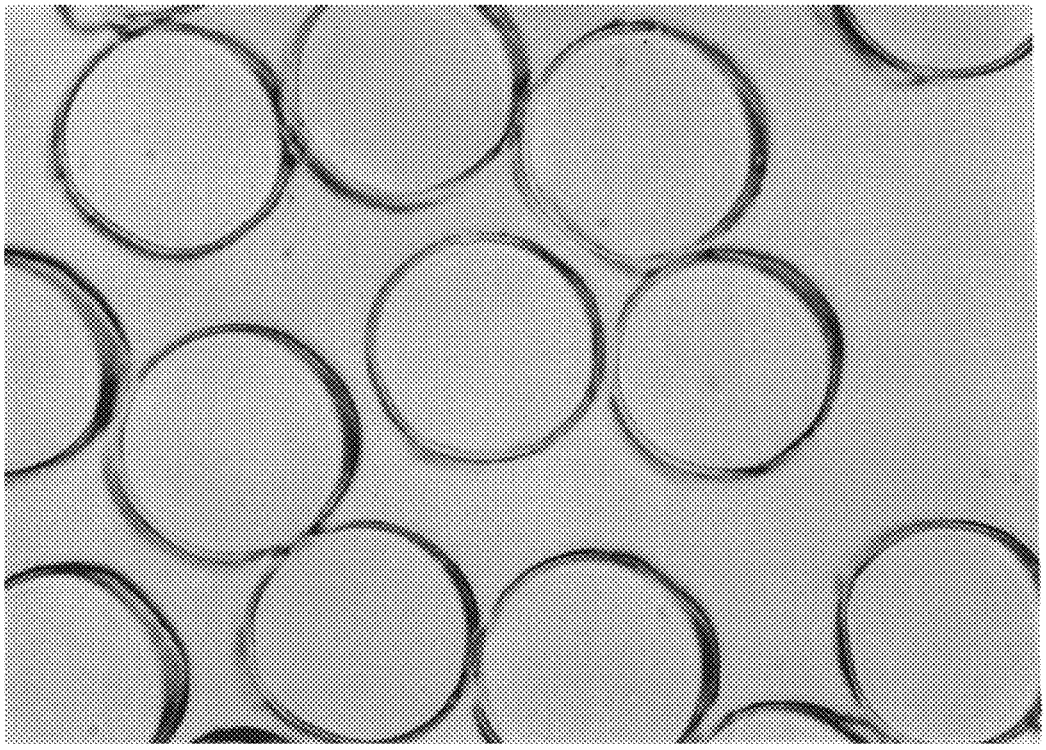
FIGS. 3A–B illustrate photomicrographs of a polyaniline-containing polypropylene fiber prepared according to the invention using a toluene based coating formulation containing 28% polyaniline by weight.
Figure 3B:
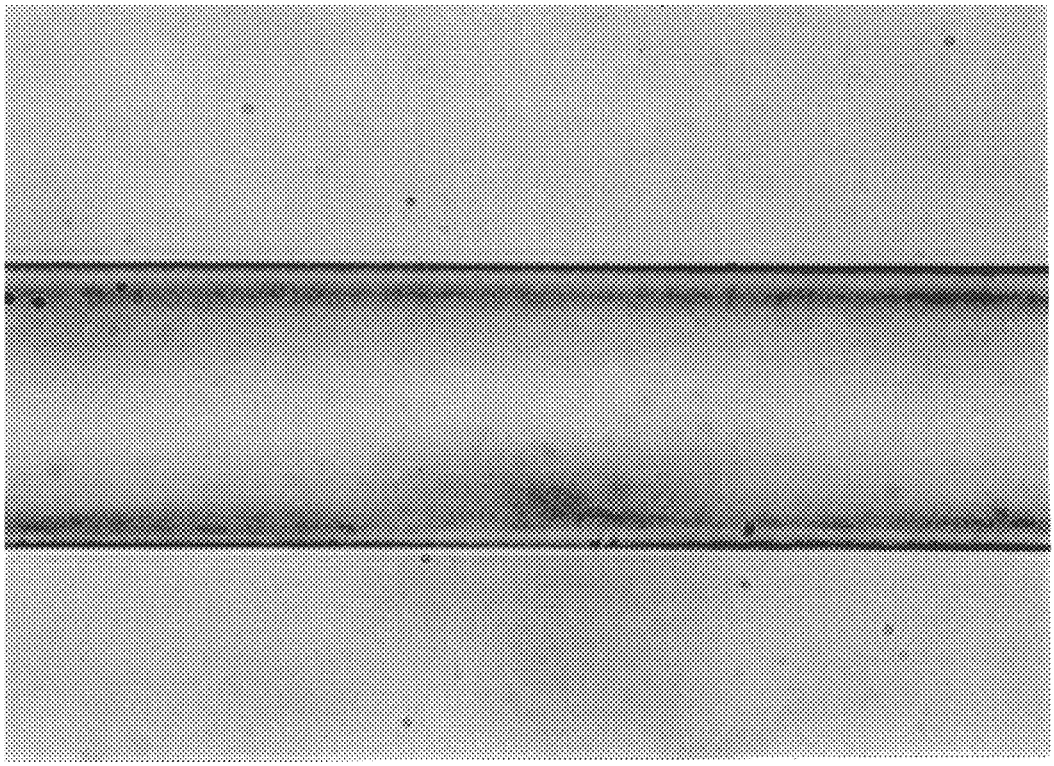
Figure 4A:
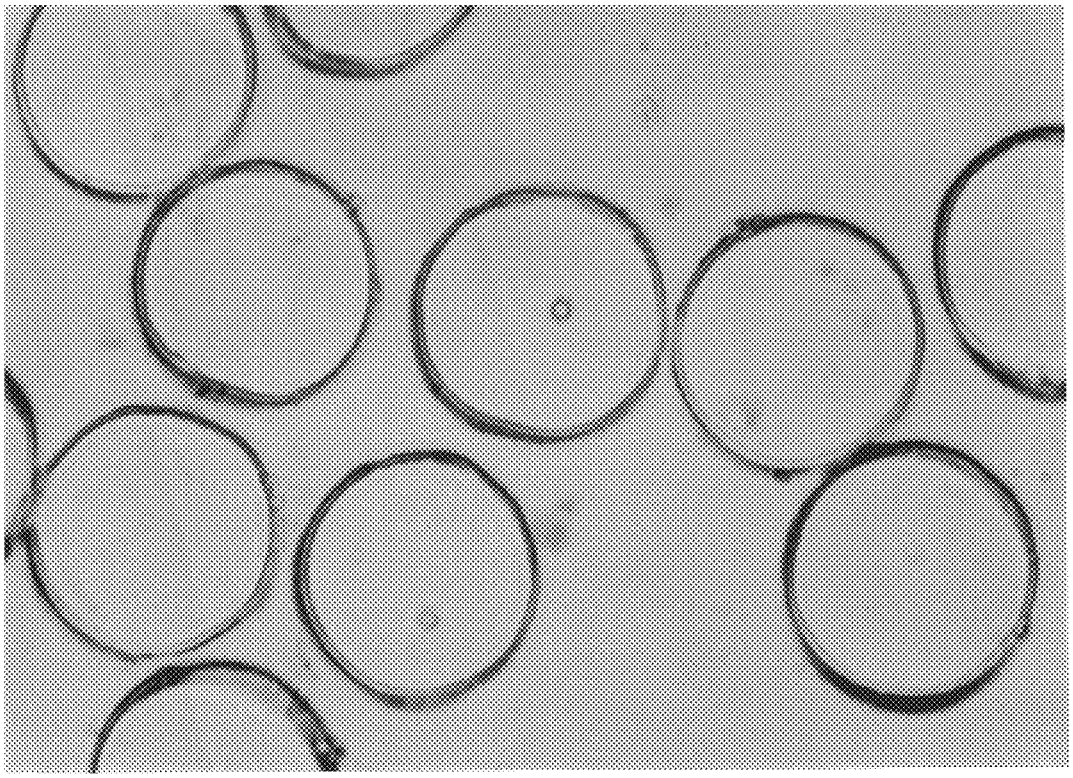
FIGS. 4A–B illustrate photomicrographs of a polyaniline-containing polypropylene fiber prepared according to the invention using the same coating formulation as in FIGS. 3A–B but applied with a wider solution applicator.
Figure 4B:
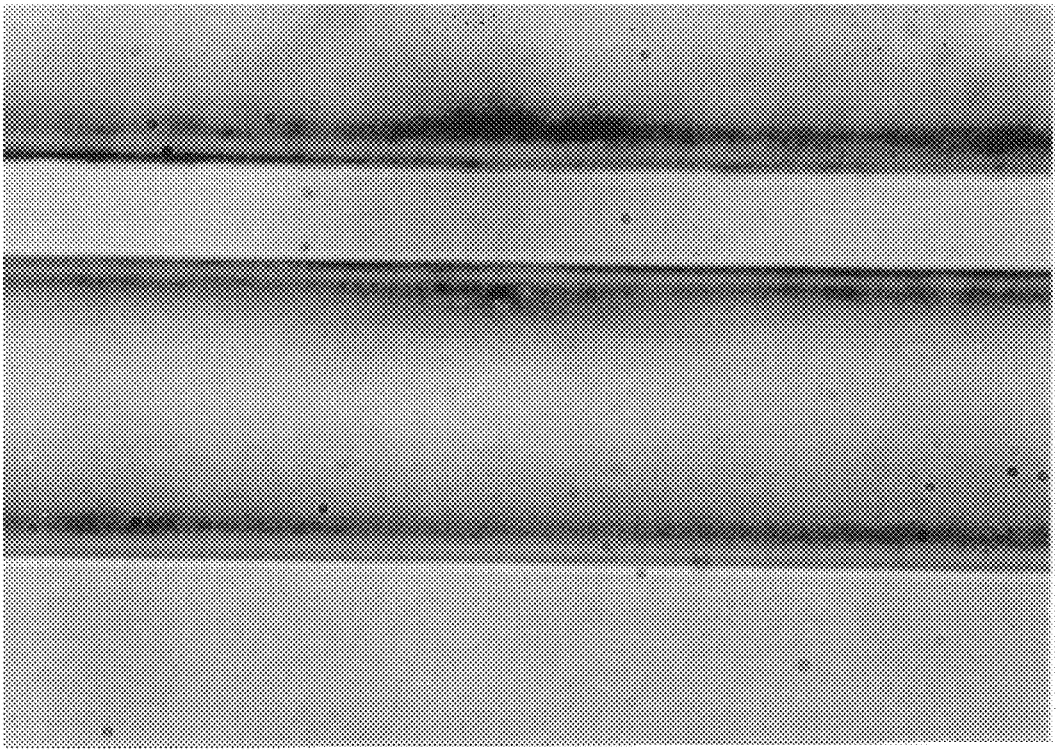
Figure 5A:
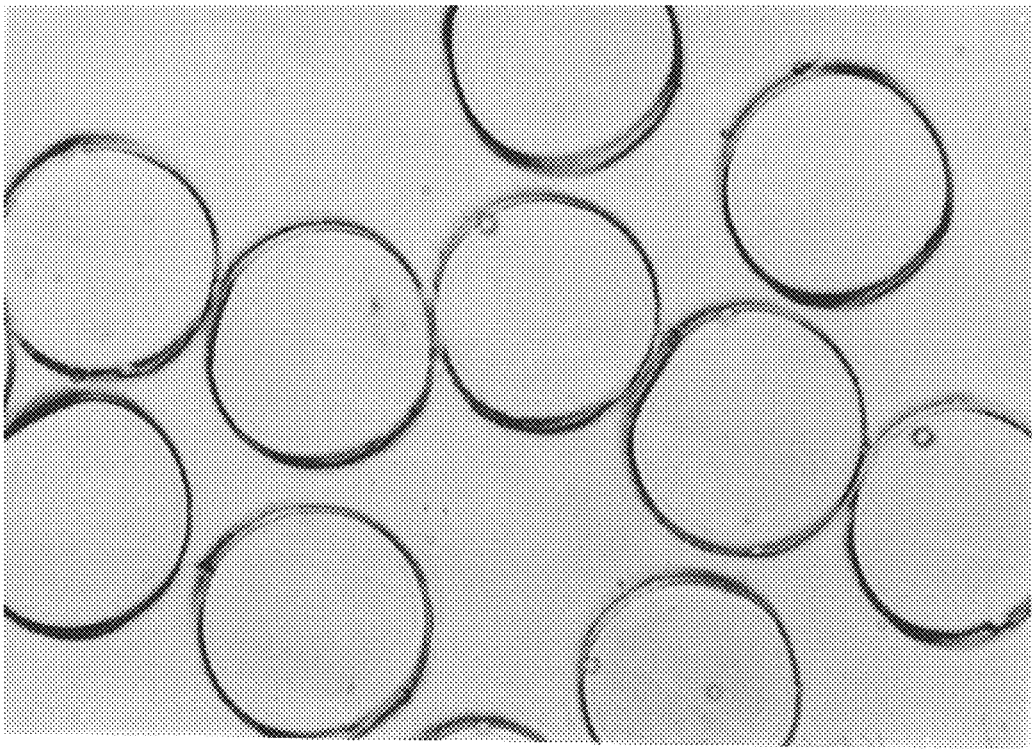
FIGS. 5A–B illustrate photomicrographs of a polyaniline-containing polypropylene fiber prepared according to the invention using a coating formulation 7% polyaniline and 3.5% polystyrene by weight.
Figure 5B:
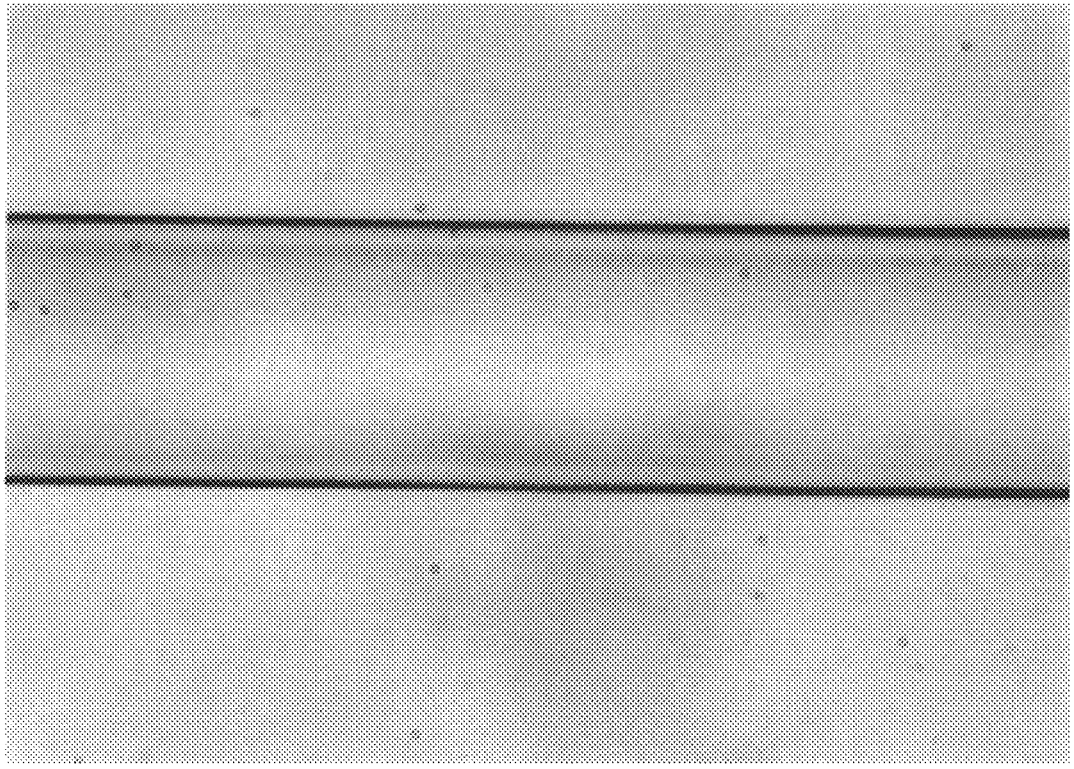

The coating step is preferably performed in such a manner that when filaments are processed together to form a fiber, substantially the entire length of the fiber contains ICP. Substantially the entire length means at least 25%, more preferably at least 50%, and most preferably at least 75%, of the length of the processed fiber. This may be accomplished by coating substantially the entire length of at least one of the filaments forming the fiber. Alternatively, partially coated filaments may be processed together to form a fiber in which the ICP-coated region on one filament overlaps the ICP-coated region on an immediately adjacent filament as shown in FIG. 2. Thus, the fiber contains a continuous conductive pathway running substantially from one end of the fiber to the other.

In certain embodiments, it may be desirable to produce a fiber having a particular electrical conductivity. Those skilled in the art will understand that the electrical conductivity of the fiber may be controlled by a number of parameters, including the amount of the ICP in the coating formulation, the percentage of each comprising filament that is coated, the thickness of the coating, and the number of coated filaments in the fiber.

In addition, for a filament coated with an organic acid salt of a polyaniline, the coated filament may be contacted with a conductivity-enhancing agent before the filaments are combined into a filament bundle. The conductivity-enhancing agent may comprise an ionic surfactant such as described above or a polar organic solvent as described in copending application Ser. No. 08/686,518 U.S. Pat. No. 5,780,572, which is incorporated herein by reference. The coated filament may be contacted with the conductivity-enhancing agent by any suitable method including spraying, dipping, or the like.

If an ionic surfactant is used as the conductivity agent, it is preferably dissolved in water at a concentration of from about 0.005 M to about 2 M, more preferably from about 0.01 M to about 1 M and most preferably from about 0.05 M to 0.5 M. The amount of increase in conductivity will depend upon the particular ionic surfactant used, the concentration of the surfactant, the time of the contact with the polyaniline coating and the temperature at which the surfactant is coated with the polyaniline salt. One skilled in the art can readily determine the optimal parameters to achieve the desired increase in conductivity.

A polar organic solvent suitable as a conductivity-enhancing agent is one in which the polyaniline composition is insoluble so that polyaniline is not extracted by treatment with the solvent. By insoluble it is meant that the polyaniline has a solubility in the polar organic solvent of less than about 1%. Polar organic solvents useful as conductivity enhancing agents include but are not limited to alcohols, esters, ethers, ketones, anilines and mixtures thereof. Preferred polar organic solvents include the alcohols, methanol, ethanol, isopropanol and the like. As would be readily understood by one skilled in the art, the time the polyaniline-containing coating is contacted with the polar organic solvent will depend both upon the solubility of the organic acid in the polar organic solvent and on the desired amount of increased conductivity. Typically, conductivity of the polyaniline coating may be enhanced by contacting the coating with methanol or acetone for about one minute or less. One skilled in the art can readily determine the optimal parameters to use to achieve the desired increase in conductivity.

After removing any excess conductivity-enhancing agent, if used, the coated filament is combined with at least one other filament comprised of the fiber-forming polymer to form a filament bundle. The at least one other filament may also be coated with the coating formulation. The filament bundle is then processed into a fiber using processing steps typical for the particular fiber spinning process and intended application of the fiber. For example, in a melt spinning process, the filament bundle might be wetted with a spin finish and would typically then be passed around one or two feed rolls followed by being wound on a bobbin.

As would be apparent to one skilled in the art of fiber manufacture, the precise details of carrying out the coating and subsequent processing steps will depend on the particular fiber manufacturing process being used and the desired properties of the resulting fiber. Such details are readily discernible to those skilled in the art.

While the preferred method employs a melt-spinning process to extrude filaments which are then coated, it is also contemplated that filaments extruded by other spinning processes may be similarly coated with an ICP before being processed into a fiber. For example, in a wet-spinning process, filaments are formed as the spinning solution begins to precipitate upon exiting the spinneret into a coagulation bath. Continued precipitation of the filaments leads to the formation of a porous fiber structure which is believed to initially comprise a network of interlocking fibrils, or filaments. Subsequent processing steps include: washing the porous fiber structure with a wash media, usually water, to remove residual spinning solvent from the filament network; stretching, or orientation, of the filament network by heating with hot water; applying a finish composition to facilitate subsequent fiber processing; and then drying to remove wash media from the external and internal areas of the filament network resulting in collapse of the network into a fiber. Thus, the filaments may be at least partially coated with an ICP by adding the ICP to one or more of the coagulation bath, the washing media, stretching water, or the finish composition.

The invention also provides a coated filament comprising a fiber-forming polymer and a coating comprising an intrinsically conductive polymer, the coating covering at least a portion of the exterior surface of the filament. The filament is extruded and coated in a spinning process as described above. Preferably, the coating covers a substantial portion of the surface area of the filament and is applied to the filament before it has completely solidified. Preferred fiber-forming polymers and coatings are those described for the above method. In particular, the coating on the filament may also comprise one or more binder materials and/or conductivity-enhancing agents. In addition, the coated portion of the filament may be treated with conductivity-enhancing agents as described above.

Industrial Applicability:

A coated filament according to the invention may be useful in a variety of applications. One use of such a coated filament is in preparing a fiber containing an ICP. The fiber comprises the coated filament and at least one other filament comprised of the fiber-forming polymer, wherein the at least one other filament may be another coated filament or a noncoated filament. Preferably, the ICP in the fiber forms an electrically-conductive pathway which is continuous substantially the entire length of the fiber. In one embodiment, the electrically-conductive pathway is formed by the coating on the coated filament. In another embodiment, the electrically-conductive pathway comprises a plurality of overlapping coatings formed by a plurality of coated filaments.

In addition to preparing electrically conductive ICP-containing fibers, the method of the present invention also allows for the preparation of nonconductive, energy absorbing ICP-containing fibers. The latter type of ICP-containing fibers may be useful in those applications that require the electrically conductive property, or the energy absorbing property, of an ICP without the need of an electrically conductive medium or matrix. For example, nonconductive ICP-salt containing fibers prepared by the method of the present invention may be useful for forming yarns or textiles which provide acoustic or vibrational energy absorption as shown in U.S. Pat. No. 5,526,324; or which absorb electromagnetic radiation, such as light waves, ultraviolet waves, microwaves, radar, or other electromagnetic waves as described, for example, in U.S. Pat. No. 5,294,694, in U.S. Pat. No. 5,381,149, in PCT publication WO90/03102 and by Olmedo et al., in *Synth. Metals*, 69, 205–208 (1995). By using nonconductive, but energy absorbing fibers of the present invention, fabrics for these uses could be easily woven, tailored and applied for shielding applications, or in stealth technology. The fibers or yarn of the present invention could also provide a convenient way to apply ICP's in applications where the anti-corrosive property of polyaniline is useful.

Another potentially useful property of polyaniline is that doped and undoped polyanilines are of different color. Polyaniline in its protonated, or salt form, is green, while its non-protonated, base form, is blue. Thus, the property of reversibly changing color from green to blue on the basis of pH could be used to provide a calorimetric sensor for acids or bases with the polyaniline conveniently immobilized in a fiber.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples all percentages are given on a weight basis unless otherwise indicated.

EXAMPLES 1–4

These examples illustrate the preparation of polyaniline-containing polypropylene fibers according to a preferred embodiment of the invention.

The polyaniline used was a composite of six formulations, each prepared by the process in U.S. Pat. No. 5,567,356 by six hour polymerization at about 8° C., from a starting mixture of water, Nacure® 1051 (50/50 w/w dinonylnapthalene sulfonic acid (DNNSA)/butyl cellosolve, available from King Industries, Norwalk, Conn.) and aniline having a DNNSA to aniline molar ratio of 1.2:1. Polymerization was initiated by adding ammonium persulfate (AP) to the reaction mixture over a time period of 15 min. to a final molar ratio of AP to aniline of 1.24:1. The resultant green organic phase was dissolved in xylenes, washed with 0.01 M $H_2SO_4$ and water, and then distilled to concentrate the product. The composite sample had a $M_n$ of 46,800, a $M_w$ of 88,300 and a $M_w$:$M_n$ of 1.9.

Figure 1B:
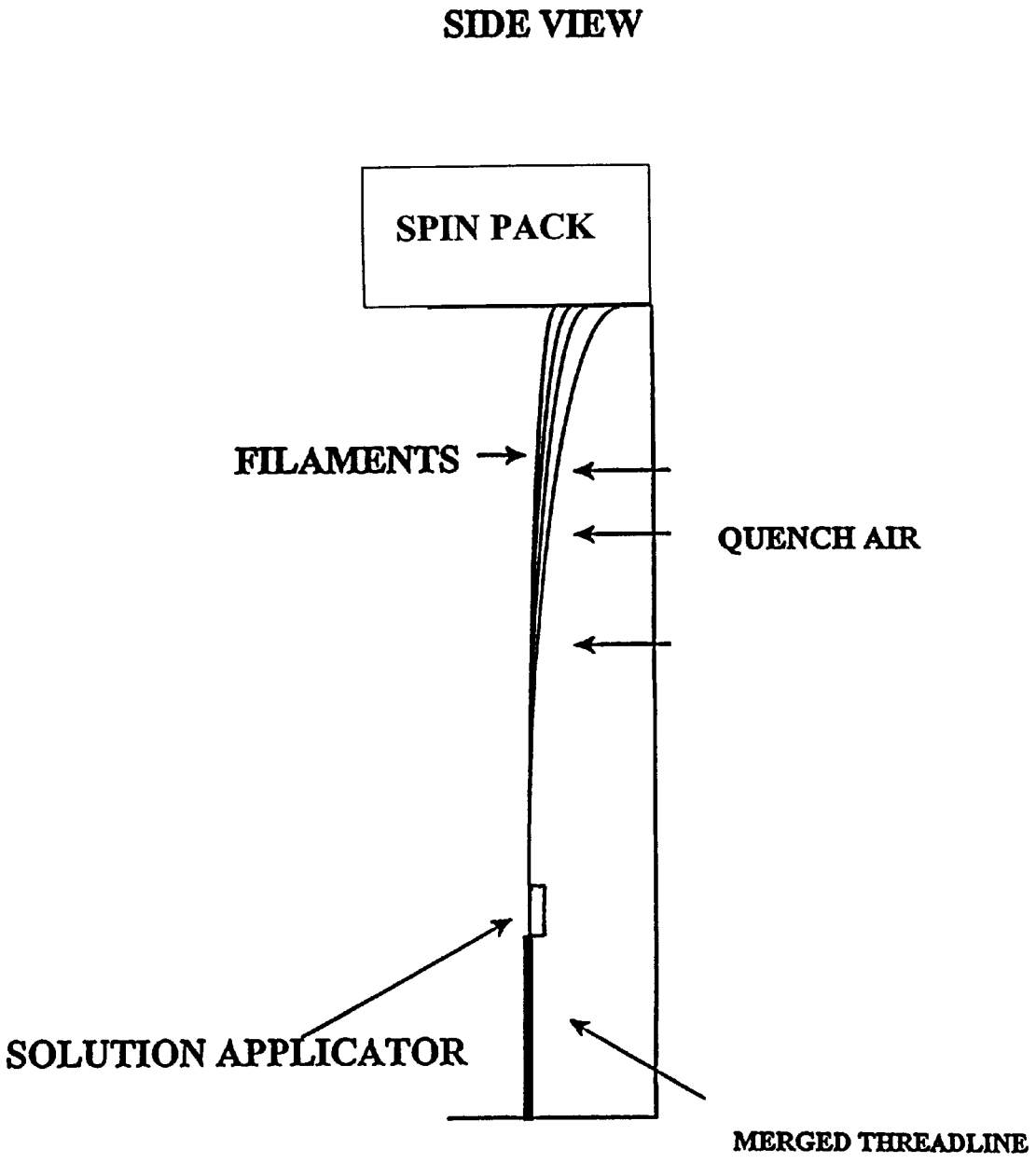

The composite polyaniline sample was used to prepare the following coating formulations:

(A) 30 g polyaniline in 250 ml toluene=14% polyaniline by weight (B) 60 g polyaniline in 250 ml toluene=28% polyaniline by weight (C) 30 g polyaniline, 15 g polystrene in 500 ml toluene=7% polyaniline, 3.5% polystyrene by weight The fibers were prepared using the melt-spinning process schematically illustrated in FIGS. 1A and 1B. Molten polypropylene was pumped at a constant rate of 15.9 g/min under high pressure through a spin pack having 16 round holes, each having a diameter of 0.01 inch. The liquid polymer streams emerged from the spin pack at a rate of about 20 meters/min and entered the approximately 89 inch long quench chimney where they began to cool and solidify into filaments. As the filaments descended towards the winder or take up-position (not shown), coating formulation A (Ex. 1), B (Ex. 2–3), or C (Ex. 4) was applied to the filaments by a dispensing system.

The dispensing system comprised a chamber for holding the coating formulation (not shown) connected to a metered pump which delivered the coating formulation at a rate of about 1.8 ml/min or about 2.4 ml/min to a narrow (1 mm×4.7 mm) or wide (1 mm×12.7 mm) slotted solution applicator, or finish guide, which was in contact with the descending filaments at a distance of about 65 inches from the spin pack face. At this point, the filaments appeared solid, but were still warm enough such that they had not completely crystallized. After passing the dispensing system, the filaments converged together into a filament bundle. Using a surface, or take-up, speed of 1000 meters/min, the filament bundle was passed around a first feed roll (not shown), then a second feed roll (not shown), and then wound onto a bobbin (not shown).

The approximate thickness of the polyaniline coating applied to the filaments in these four examples was calculated from the extrusion and coating application flow rates and is reported in Table I below.

EXAMPLE 5

This example illustrates the conductivity of the fibers prepared in Examples 1–4.

The conductivity of the polyaniline-containing fibers was determined as follows. A measured length of fiber was weighed to calculate the denier and then tightly twisted and placed between two electrodes, 6 cm apart, of a Keithley 8002 A High Resistance Text Fixture. A voltage (100 V) was applied to the electrodes and the resistance of the fiber read on a Keithley 487 Picoammeter/Voltage source. The resistivity data is shown in Table I below:

TABLE I

| Example | Coating Formul · | Finish Guide | Coating Thickness (microns) | Denier | Resistivity ohm/cm |
|---|---|---|---|---|---|
| 1 | A | Narrow | 0.1 | 1400 | $>1 \times 10^{16}$ |
| 2 | B | Narrow | 0.15 | 1200 | $1.0 \times 10^{7}$ |
| | | | | 2100 | $1.3 \times 10^{7}$ |
| 3 | B | Wide | 0.15 | 4600 | $2.1 \times 10^{9}$ |
| | | | | 4900 | $3.3 \times 10^{9}$ |
| 4 | C | Narrow | 0.1 | 1800 | $1.0 \times 10^{12}$ |
| | | | | 2000 | $1.0 \times 10^{12}$ |

With the exception of the fiber prepared in Example 1, the polyaniline-containing polypropylene fibers had lower resistivity and thus higher conductivity than traditional polypropylene fibers whose resistivity is off scale in this system, i.e., greater than $1\times10^{16}$ ohm/cm.

EXAMPLE 6

This example illustrates microscopic analysis of the fibers prepared in Examples 1–4.

Ten micron thick cross-sections were prepared with a cryostat microtome and observed with bright field microscopy under 640× magnification. Photomicrographs of the cross-sections are shown in FIGS. 2A, 3A, 4A, and 5A.

Photomicrographs of longitudinal views of individual filaments within the fibers were taken at 640× magnification and are shown in FIGS. 2B, 3C, 4D, and 5E.

The fibers prepared in Examples 1–4 were light green in color as would be expected for the conducting form of polyaniline. FIGS. 2–5 are photographs of cross-sections and longitudinal views of these fibers showing the polyaniline cotings on the outer surface as having a bluish tint. In the longitudinal views of intact filaments, the polyaniline coating shows a greater color intensity at the edge of the fiber where the surface of the filament curves away from the viewing position. In all four experiments, the majority of the filaments in the fiber appeared to be coated with polyaniline over a substantial portion of their surface area.

In view of the above, it will be seen that the several advantages of the invention are achieved and other advantageous results attained.

As various changes could be made in the above methods and compositions without departing from the scope of the invention, it is intended that all matter contained in the above description and shown in the accompanying drawings shall be interpreted as illustrative and not in a limiting sense.

What is claimed:

1. A method for spinning fibers containing intrinsically conductive polymers comprising the steps of (a) extruding two or more filaments comprised of a fiber-forming polymer;

(b) applying a coating formulation to at least a portion of at least one of the filaments before combining the filaments to form a filament bundle, said coating formulation comprising a salt of an intrinsically conductive polymer in a carrier solvent;

(c) combining the filaments to form a filament bundle; and (d) processing the filament bundle into a fiber.

2. The method of claim 1, wherein the ICP is selected from the group consisting of: polyacetylene; polyaniline; polypyrrole; polythiophene; and mixtures, derivatives, and copolymers thereof.

3. The method of claim 2, wherein the salt of the ICP comprises an organic acid salt of polyaniline.

4. The process of claim 3, wherein the organic acid is dinonylnaphthalene sulfonic acid.

5. The process of claim 1, wherein the ICP is comprised of particles and the coating formulation comprises a dispersion of the ICP particles in the carrier solvent.

6. The process of claim 1, wherein the ICP is soluble in the carrier solvent.

7. The process of claim 6, wherein the carrier solvent is selected from the group consisting of xylene, toluene, 4-methyl-2-pentanone, trichloroethylene, butylacetate, 2-butoxyethanol, n-decyl alcohol, chloroform, hexanes, cyclohexane, 1-pentanol, 1-butanol, 1-octanol, 1,4-dioxane, cyclohexane, and m-cresol.

8. The process of claim 7, wherein the carrier solvent is toluene.

9. The process of claim 1, wherein the coating formulation further comprises a binder.

10. The process of claim 4, wherein the coating formulation further comprises an ionic surfactant.

11. The process of claim 1 wherein the at least one filament is incompletely solidified when the coating is applied.

12. The process of claim 11, wherein the filaments are extruded in a melt-spinning process.

13. The process of claim 12, wherein the fiber-forming polymer is a polyamide, polypropylene, or polyester.

14. The process of claim 13 wherein the fiber forming polymer is polypropylene.

15. A fiber containing an intrinsically conductive polymer prepared by the process of claim 1.

16. The fiber of claim 15 wherein the salt of the ICP comprises an organic acid salt of polyanline.

17. The fiber of claim 16, wherein the organic acid is dinonylnaphthalene sulfonic acid.

18. The fiber of claim 17, wherein the carrier solvent is toluene.

19. A fiber containing an intrinsically conductive polymer prepared by the process of claim 12.

20. A coated filament comprising a fiber-forming polymer and a coating comprising an ICP, said coated filament being prepared by (a) extruding a filament in a fiber spinning process; and (b) applying a coating formulation to at least a portion of the filament before the filament has completely solidified, said coating formulation comprising a salt of an ICP in a carrier solvent.

* * * * *